United States Patent [19]

Nishimoto

[11] 4,347,772

[45] Sep. 7, 1982

[54] ELECTRONIC MUSICAL INSTRUMENTS CAPABLE OF VARYING TONE PITCH DURING ONE KEY DEPRESSION

[75] Inventor: Tetsuo Nishimoto, Hamamatsu, Japan

[73] Assignee: Nippon Gakki Seizo Kabushiki Kaisha, Hamamatsu, Japan

[21] Appl. No.: 205,708

[22] Filed: Nov. 10, 1980

[30] Foreign Application Priority Data

Nov. 21, 1979 [JP] Japan ..... 54-151082

[51] Int. Cl.[3] ..... G10F 1/00

[52] U.S. Cl. ..... 84/1.03; 84/1.24

[58] Field of Search ..... 84/1.24, 1.01, 1.03

[56] References Cited

U.S. PATENT DOCUMENTS 3,929,053 12/1975 Deutsch ..... 84/1.24
4,103,581 8/1978 Deutsch ..... 84/1.24
4,179,971 12/1979 Takahashi et al. ..... 84/1.24
4,185,530 1/1980 Robinson et al. ..... 84/1.03
4,198,892 4/1980 Gross ..... 84/1.24
4,237,764 12/1980 Suzuki ..... 84/1.24

*Primary Examiner*—J. V. Truhe
*Assistant Examiner*—Forester W. Isen
*Attorney, Agent, or Firm*—Spensley, Horn, Jurbas & Lubitz

[57] ABSTRACT

For the purpose of sequentially varying a tone pitch of a generated musical tone, a variation information generator is provided which is operable by a performer to generate a variation information designating an arvitrary variation rate of the tone pitch. An operation circuit is provided for producing a modified frequency information in response to the variation information and a frequency information representing a tone pitch regarding a depressed key. The modified frequency information is supplied to a musical tone signal generator and the output thereof is applied to a sound system for generating the musical tone, thereby obtaining a musical effect similar to glissando or portamento and having an arbitrary variation rate.

18 Claims, 13 Drawing Figures

ELECTRONIC MUSICAL INSTRUMENTS CAPABLE OF VARYING TONE PITCH DURING ONE KEY DEPRESSION

BACKGROUND OF THE INVENTION

This invention relates to an electronic musical instrument more particularly an electronic musical instrument, which is capable of successively varying the tone pitch of a generated musical tone, further capable of setting an arbitrary width of pitch variation.

As has been well known in the art, there has been proposed an electronic musical instrument wherein the tone pitch of the generated musical tone is gradually varied over a predetermined pitch variation width so as to provide such various effects regarding pitch variation as a glissando effect, a portamento effect and a pitch bender effect. Each of these portamento, glissando and pitch bender effects is obtained by controlling the tone pitch of the generated musical tone. More particularly, the glissando effect is obtained by stepwisely varying the tone pitch of the generated musical tone from one pitch to the other at a spacing of semitone, whereas the portamento effect is obtained by smoothly and continuously varying the tone pitch of the generated musical tone from one tone pitch to the other. The difference between the glissando effect and the portamento effect lies in that whether the width of pitch variation (amount of variation of the tone pitch per unit time) is equal to semitone or smaller than it. In other words, it may be considered that when the width of variation of the tone pitch of the glissando effect is made extremely small, a portamento effect is obtained. The pitch bender effect is obtained when the tone pitch of the generated musical tone is varied to other pitch above or below the nominal pitch in accordance with the amount of the operation of a operating member.

However, in the prior art electronic musical instrument since the variation of the tone pitch is limited to a spacing of semitone scale or to a smooth variation, the musical expression effect would also be limited.

SUMMARY OF THE INVENTION

Accordingly, it is an object of this invention to provide an improved electronic musical instrument capable of producing musical tones rich in the musical expression effect.

Another object of this invention is to provide a novel electronic musical instrument in which a performer can freely set a unit variation width (variation step width when the pitch of the generated musical tone is to be sequentially varied).

According to this invention, there is provided an electronic musical instrument comprising keyboard means having a plurality of keys, a frequency information generator for generating a first frequency information corresponding to a tone pitch designated by a depressed one of the keys, calculating means for generating a second frequency information in accordance with the first frequency information, the second frequency information varying stepwisely from a first value to a second value for generating a musical tone signal having a frequency corresponding to the value of the second frequency information, a second system for converting the musical tone signal into a musical tone, a pitch variation information generator for generating a pitch variation information, and a pitch variation designator for arbitrarily designating the pitch variation information to be produced by the pitch variation information generator.

DESCRIPTION OF THE PREFERRED EMBODIMENTS

(1) Construction

Figure 1:
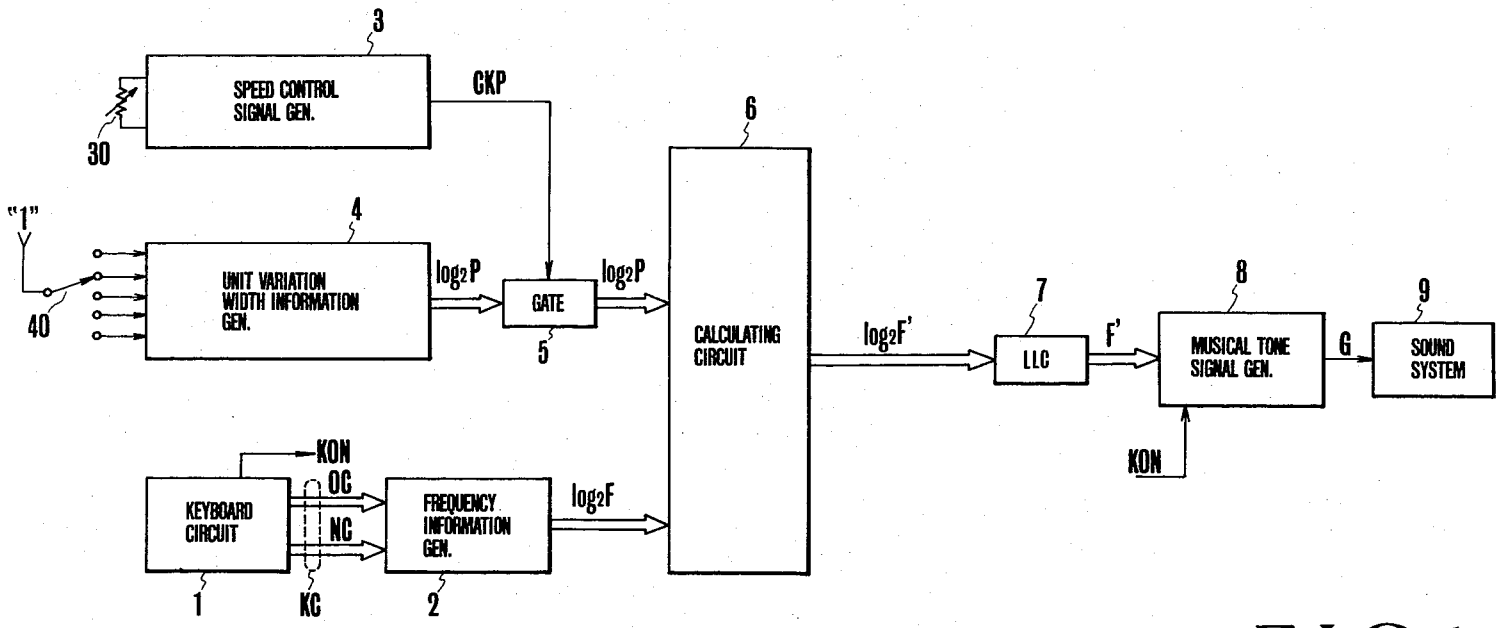
FIG. 1 is a block diagram showing one embodiment of an electronic musical instrument according to this invention.

A preferred embodiment of this invention shown in FIG. 1 shows an application of this invention to an electronic musical instrument constructed to obtain a glissando effect (including a portamento effect).

As shown there is provided a keyboard circuit 1 provided for the keyboard, not shown, of the electronic musical instrument. The keyboard circuit 1 has a plurality of key switches corresponding to respective keys of the keyboard. When a key is depressed, a corresponding key switch is operated to produce a key code KC comprising an octave code OC representing of note where the depressed key belongs and a note code NC representing the name of note, and a key-on signal KON showing that either one of the keys has been depressed. In this example, the keyboard circuit 1 has a capability of storing and holding a key code KC representing the depressed key and constructed to continuously output the key code KC of the depressed key even after release thereof until another key is operated.

A frequency information generator 2 is provided which is connected to receive the key code KC produced by the keyboard circuit 1 for producing a frequency information $\log_2 F$ expressed as a logarithm which is a logarithm of frequency number F expressed as a natural number corresponding to tone pitch of a depressed key.

Figure 3:
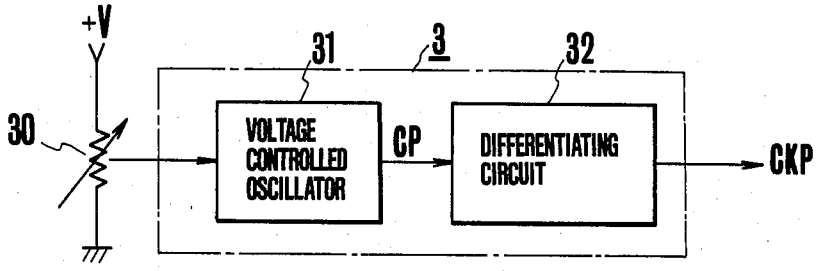
FIG. 3 is a connection diagram showing the detail of one example of the speed control signal generator shown in FIG. 1.

A speed control signal generator 3 produces a speed control signal CKP which sets and controls the pitch varying speed of the glissando effect (including the portamento effect). As shown in FIG. 3, it is constructed to produce the speed control signal CKP having a period $\Delta t$ corresponding to the set position of a variable resistor 30.

There is also provided a unit variation width information generator 4 which produces a unit variation width information that sets the pitch variation width per unit time (the period of $\Delta t$) of the glissando effect including the portamento effect. In this example it is constructed to produce a unit variation width information having a value corresponding to an operated position of a transfer switch 40 shown in FIG. 4. In this example, the unit variation width information is expressed in terms of cents, so that respective stationary contacts of the transfer switch 40 is labelled with data (scale) in terms of cent.

As is well known in the art, the cent value is expressed as a logarithm with 2 as a base so that the unit variation width information generator 4 produces a logarithmic unit variation information $\log_2 P$.

A gate circuit 5 is provided to sequentially send out the unit variation width information $\log_2 P$ at a period $\Delta t$ of the speed control signal CKP generated by the speed control signal generator 3.

A calculating circuit 6 is provided which is connected to receive the frequency information $\log_2 F$ produced by the frequency information generator 2 and the unit variation width information $\log_2 P$ outputted from the gate circuit 5 for producing a modified frequency information $\log_2 F'$ whose value sequentially varies toward the frequency information $\log_2 F$ based on these informations $\log_2 F$ and $\log_2 P$, with a pitch variation width corresponding to the unit variation width information $\log_2 P$, the value of the modified frequency information $\log_2 F'$ varing at a period of the speed control signal CKP outputted by the gate circuit 5. The calculating circuit 6 compares previously inputted frequency information $\log_2 F$ with a modified frequency information $\log_2 F'$ now being inputted and according to the result of comparison adds or subtracts a unit variation width information $\log_2 P$ to and from the modified frequency information to produce the result of operation as a next new modified frequency information $\log_2 F'$. These calculating operations are repeated. The content of the calculating operation of the calculating circuit 6 is shown by the following equations 1 and 2 wherein $\Sigma$ represents the result of calculation that is the next new modified frequency information $\log_2 F'$.

A. When $\log_2 F > \log_2 F'$ $$\Sigma = \log_2 F' + \log_2 P \quad (1)$$

B. When $\log_2 F < \log_2 F'$ $$\Sigma = \log_2 F' - \log_2 P \quad (2)$$

In this case, after $\Sigma$ becomes equal to $\log_2 F$, this frequency information $\log_2 F$ is outputted as the modified frequency information $\log_2 F'$ until the frequency information $\log_2 F$ outputted from the frequency information generator 2 varies, that is next new key is depressed, and this modified frequency information $\log_2 F$ is temporarily stored in a register in the calculating circuit. Consequently, the calculating circuit 6 produces the modified frequency information $\log_2 F'$ which varies with time at the pitch variation width of the unit variation width $\log_2 P$ and at a speed of variation corresponding to the period $\Delta t$ of the speed control signal CKP until the modified frequency information $\log_2 F'$ coincides with the frequency information $\log_2 F$.

There are further provided a logarithm number to a natural number converter 7 (LLC) which converts the modified frequency information $\log_2 F'$ outputted from the calculating circuit 6 into a corresponding natural number, and a musical tone signal generator 8 which produces a musical tone signal G having a tone pitch corresponding to the modified frequency information F' expressed as a natural number outputted from the LLC 7. The musical tone signal generator 8 is inputted with the key-on signal KON produced by the keyboard circuit 1 so as to effect such tone generation control as imparting an amplitude envelope to the musical tone signal G generated in accordance with the key-on signal.

The musical tone signal G is applied to a sound system 9 from the musical tone signal generator for producing a musical tone.

Operation

To commence a performance, the pitch variation speed of the glissando effect is set by the variable resistor 30 and the unit variation width information $\log_2 P$ regarding the pitch variation width per unit time is set by the transfer switch 40. Then, the speed control signal generator 3 produces a speed control signal CKP having a period $\Delta t$ set by the variable resistor 30, whereas the unit variation width information generator 4 produces a unit variation width information $\log_2 P$ set by the transfer switch 40. Accordingly, the unit variation width information $\log_2 P$ is supplied to the calculating circuit 6 via the gate circuit 5 each time the speed control signal CKP is generated.

Under these conditions, when a key of the keyboard is depressed, the keyboard circuit 1 produces a key code KC corresponding to the depressed key and a key-on signal. The key code KC is supplied to the frequency information generator 2 for producing a frequency information $\log_2 F$ corresponding to the tone pitch of the depressed key. Assume now that the frequency information produced by the depressed key is expressed by $\log_2 Fa$, this frequency information is applied to the calculating circuit 6 where it is compared with a modified frequency information $\log_2 F'$ being produced at that time, that is a frequency information $\log_2 F$ (it is designated by $\log_2 Fb$) corresponding to any key depressed immediately. Depending upon the result of comparison, a calculation according to equation (1) or (2) is executed and the result of calculation $\Sigma$ is outputted as a modified frequency information $\log_2 F'$ regarding the newly depressed key.

Figure 2:
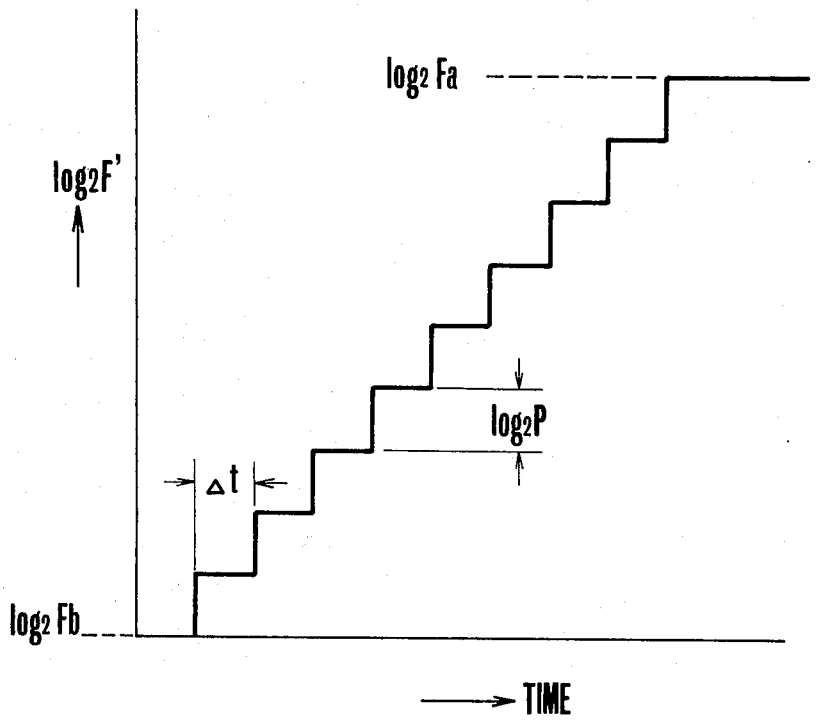
FIG. 2 is a graph showing one example of the manner of varying a modified frequency information $\log_2 F'$ produced by the calculating circuit shown in FIG. 1.

When the result of comparison of the frequency information $\log_2 Fa$ corresponding to the newly depressed key with the frequency information $\log_2 Fb$ corresponding to the key depressed immediately before is $\log_2 Fa < \log_2 Fb$, a modified frequency information $\log_2 F'$ regarding the newly depressed key which varies as shown in FIG. 2 is produced.

The modified frequency information log $_2F'$ produced from the calculating circuit 6 in this manner is converted into a corresponding natural number modified frequency information F' by LLC 7 and then applied to the musical tone signal generator 8. Then, passed on the inputted modified frequency information F', the musical tone signal generator 8 generates a musical tone signal G which sequentially approaches the tone pitch of the newly depressed key from the tone pitch of the key depressed immediately before at a speed of variation corresponding to the period Δt of the speed control signal CKP and with a pitch variation width corresponding to the unit variation width information log $_2P$. This musical signal G is controlled by the key-on signal KON to be imparted with an amplitude envelope and then supplied to the sound system 9. Then, the sound system 9 produces a musical tone imparted with the glissando effect, the pitch of the musical tone sequentially approaching to the tone pitch of the newly depressed key from that of the key depressed immediately before at a pitch variation speed corresponding to the period Δt of the speed control signal CKP and with a pitch variation width corresponding to the unit variation width information log $_2P$.

With the electronic musical instrument constructed as above described, when the unit variation width information log $_2P$ is set to an extremely small value by manipulating the transfer switch 40 a musical tone can be produced which is imparted with the portamento effect with the tone pitch smoothly varied, whereas when the unit variation width information log $_2P$ is set to a value corresponding to semitone (100 cents) it is possible to produce a musical tone imparted with a glissando effect similar to that of the prior art. Thus, setting the unit variation width information log $_2P$ to a desired value produces a glissando effect having a novel expression effect.

Although in this embodiment, the period Δt of the speed control signal CKP and the value of the unit variation width information log $_2P$ are set with a variable resistor and a transfer switch, it should be understood that the period Δt and the value of log $_2P$ can be digitally set by using a ten key or the like.

Furthermore according to this invention the equations (1) and (2) are calculated by the calculating circuit 6 for obtaining a glissando effect including a portamento effect in which the pitch of the produced musical tone gradually varies toward the tone pitch of a newly depressed key from the tone pitch of a key depressed immediately before, but where the calculating circuit 6 is constructed to operate the following equation (3) or (4), a glissando effect can be obtained in which the pitch of the generated musical tone gradually varies toward the tone pitch of a newly depressed key from an initial value equal to a tone pitch spaced from that of the newly depressed key by predetermined cents (for instance 2400 cents=2 octaves), in the positive or negative direction.

$$\Sigma(=\log_2 F')=\log_2 F-\log_2 K+q\cdot\log_2 P \quad (3)$$

$$\Sigma(=\log_2 F')=\log_2 F+\log_2 K+q\cdot\log_2 P \quad (4)$$

in which log $_2K$ represents a constant utilized to set an initial value (start value) of the glissando effect, and q the timing (the period Δt of the speed control signal) of outputting the unit variation width information log $_2P$ from the gate circuit 5, the timing gradually increasing as 1, 2, 3 . . . .

The details of various circuits shown in FIG. 1 will now be described.

Keyboard circuit 1

Although not shown in detail, the keyboard circuit 1 comprises a plurality of key switches corresponding to respective keys, an encoder for converting the outputs of respective key switches into key codes KC, and a latch circuit for storing and holding the key codes KC.

Each key code KC is made up of 4 bit octave code OC($O_4-O_1$) representing an octave range, and a 4 bit note code NC ($N_4-N_1$) representing a note name. The octave codes OC and the note codes are suitably combined to represent respective keys. In this embodiment, respective octave tone range as shown in the following Table Ia are assigned as the contents of octave codes OC, and notes shown in the following Table Ib are assigned as the contents of respective note codes NC.

TABLE Ia

| Tone range | Octave Code (OC) $O_4$ | $O_3$ | $O_2$ | $O_1$ | Decimal representation |
|---|---|---|---|---|---|
| $C_{-5}$-$B_{-5}$ | 0 | 0 | 0 | 0 | 0 |
| $C_{-4}$-$B_{-4}$ | 0 | 0 | 0 | 1 | 1 |
| $C_{-3}$-$B_{-3}$ | 0 | 0 | 1 | 0 | 2 |
| $C_{-2}$-$B_{-2}$ | 0 | 0 | 1 | 1 | 3 |
| $C_{-1}$-$B_{-1}$ | 0 | 1 | 0 | 0 | 4 |
| $C_0$-$B_0$ | 0 | 1 | 0 | 1 | 5 |
| $C_1$-$B_1$ | 0 | 1 | 1 | 0 | 6 |
| $C_2$-$B_2$ | 0 | 1 | 1 | 1 | 7 |
| $C_3$-$B_3$ | 1 | 0 | 0 | 0 | 8 |
| $C_4$-$C_4$ | 1 | 0 | 0 | 1 | 9 |
| $C_5$-$B_5$ | 1 | 0 | 1 | 0 | 10 |
| $C_6$-$B_6$ | 1 | 0 | 1 | 1 | 11 |
| $C_7$-$B_7$ | 1 | 1 | 0 | 0 | 12 |
| $C_8$-$B_8$ | 1 | 1 | 0 | 1 | 13 |
| $C_9$-$B_9$ | 1 | 1 | 1 | 0 | 14 |
| $C_{10}$-$B_{10}$ | 1 | 1 | 1 | 1 | 15 |

TABLE Ib

| Note name | Note Code (NC) $N_4$ | $N_3$ | $N_2$ | $N_1$ | Decimal representation |
|---|---|---|---|---|---|
| C | 0 | 0 | 0 | 0 | 0 |
| C# | 0 | 0 | 0 | 1 | 1 |
| D | 0 | 0 | 1 | 0 | 2 |
| D# | 0 | 1 | 0 | 0 | 4 |
| E | 0 | 1 | 0 | 1 | 5 |
| F | 0 | 1 | 1 | 0 | 6 |
| F# | 1 | 0 | 0 | 0 | 8 |
| G | 1 | 0 | 0 | 1 | 9 |
| G# | 1 | 0 | 1 | 0 | 10 |
| A | 1 | 1 | 0 | 0 | 12 |
| A# | 1 | 1 | 0 | 1 | 13 |
| B | 1 | 1 | 1 | 0 | 14 |

With this keyboard circuit 1, as a key of a tone pitch C#1 for instance is depressed on the keyboard, an 8 bit key code "01100001" constructed by an octave code OC of "0110" and representing the tone pitch C#1 and a note code NC of "0001" is produced concurrently with a key-on signal KON showing that a certain key has been depressed.

Frequency information generator 2

The frequency information generator 2 is constituted by a frequency information memory device which stores frequency informations log $_2F$ corresponding to the tone pitches of respective keys as shown in the following Table IIb, the most significant bit of each frequency information being added with a weight to become 9600 cents, while the least significant bit being added with a weight to become 1.2 cents as shown in the following Table IIa. When a key code KC corresponding to a depressed key having a tone pitch of $C\#_{-5}$ is applied to the frequency information memory device to act as an address signal, frequency information log $_2F$ having a content of "00000001010101" will be read out from the memory device. Thus, for a reference tone pitch $C_{-5}$, a frequency information log $_2F$ corresponding to a frequency ratio of $(75+18.8+4.7+1.2=99.7\approx 100)$ cents will be read out.

TABLE IIa

| | Bit | Cent Value |
|---|---|---|
| | $B_{13}$(MSB) | 9600 |
| | $B_{12}$ | 4800 |
| | $B_{11}$ | 2400 |
| | $B_{10}$ | 1200 |
| Frequency information log $_2F$ 14 total bits | $B_9$ | 600 |
| | $B_8$ | 300 |
| | $B_7$ | 150 |
| | $B_6$ | 75 |
| | $B_5$ | 37.5 |
| | $B_4$ | 18.8 |
| | $B_3$ | 9.4 |
| | $B_2$ | 4.7 |
| | $B_1$ | 2.3 |

TABLE IIa-continued

| Bit | Cent Value |
|---|---|
| $B_0$(LSB) | 1.2 |

TABLE IIb

| Address | Tone Pitch | Key Code KC $0_4$ | $0_3$ | $0_2$ | $0_1$ | $N_4$ | $N_3$ | $N_2$ | $N_1$ | Frequency Information log $_2F$ $B_{13}\ldots B_6$ | $B_5\ldots B_0$ | Cent Representation |
|---|---|---|---|---|---|---|---|---|---|---|---|---|
| 0 | $C_{-5}$ | 0 | 0 | 0 | 0 | 0 | 0 | 0 | 0 | 00000000 | 000000 | 0 |
| 1 | $C\#_{-5}$ | 0 | 0 | 0 | 0 | 0 | 0 | 0 | 1 | 00000001 | 010101 | 99.7 ≅ 100 |
| 2 | $D_{-5}$ | 0 | 0 | 0 | 0 | 0 | 0 | 1 | 0 | 00000010 | 101010 | 199.2 ≅ 200 |
| 4 | $D\#_{-5}$ | 0 | 0 | 0 | 0 | 0 | 1 | 0 | 0 | 00000100 | 000000 | 300 |
| 5 | $E_{-5}$ | 0 | 0 | 0 | 0 | 0 | 1 | 0 | 1 | 00000101 | 010101 | 399.7 ≅ 400 |
| 6 | $F_{-5}$ | 0 | 0 | 0 | 0 | 0 | 1 | 1 | 0 | 00000110 | 101010 | 499.2 ≅ 500 |
| 8 | $F\#_{-5}$ | 0 | 0 | 0 | 0 | 1 | 0 | 0 | 0 | 00001000 | 000000 | 600 |
| 9 | $G_{-5}$ | 0 | 0 | 0 | 0 | 1 | 0 | 0 | 1 | 00001001 | 010101 | 699.7 ≅ 700 |
| 10 | $G\#_{-5}$ | 0 | 0 | 0 | 0 | 1 | 0 | 1 | 0 | 00001010 | 101010 | 799.2 ≅ 800 |
| 12 | $A_{-5}$ | 0 | 0 | 0 | 0 | 1 | 1 | 0 | 0 | 00001100 | 000000 | 900 |
| 13 | $A\#_{-5}$ | 0 | 0 | 0 | 0 | 1 | 1 | 0 | 1 | 00001101 | 010101 | 999.7 ≅ 1000 |
| 14 | $B_{-5}$ | 0 | 0 | 0 | 0 | 1 | 1 | 1 | 0 | 00001110 | 101010 | 1099.2 ≅ 1100 |
| Address | Tone Pitch | Key Code KC $0_4$ | $0_3$ | $0_2$ | $0_1$ | $N_4$ | $N_3$ | $N_2$ | $N_1$ | Frequency Information $B_{13}\ldots B_6$ | $B_5\ldots B_0$ | Cent Representation |
| 16 | $C_{-4}$ | 0 | 0 | 0 | 1 | 0 | 0 | 0 | 0 | 00010000 | 000000 | 1200 |
| 17 | $C\#_{-4}$ | 0 | 0 | 0 | 1 | 0 | 0 | 0 | 1 | 00010001 | 010101 | 1299.7 |
| 18 | $D_{-4}$ | 0 | 0 | 0 | 1 | 0 | 0 | 1 | 0 | 00010010 | 101010 | 1399.2 |
| 20 | $D\#_{-4}$ | 0 | 0 | 0 | 1 | 0 | 1 | 0 | 0 | 00010100 | 000000 | 1500 |
| 21 | $E_{-4}$ | 0 | 0 | 0 | 1 | 0 | 1 | 0 | 1 | 00010101 | 010101 | 1599.7 |
| 22 | $F_{-4}$ | 0 | 0 | 0 | 1 | 0 | 1 | 1 | 0 | 00010110 | 101010 | 1699.2 |
| 24 | $F\#_{-4}$ | 0 | 0 | 0 | 1 | 1 | 0 | 0 | 0 | 00011000 | 000000 | 1800 |
| 25 | $G_{-4}$ | 0 | 0 | 0 | 1 | 1 | 0 | 0 | 1 | 00011001 | 010101 | 1899.7 |
| 26 | $G\#_{-4}$ | 0 | 0 | 0 | 1 | 1 | 0 | 1 | 0 | 00011010 | 101010 | 1999.2 |
| 28 | $A_{-4}$ | 0 | 0 | 0 | 1 | 1 | 1 | 0 | 0 | 00011100 | 000000 | 2100 |
| 29 | $A\#_{-4}$ | 0 | 0 | 0 | 1 | 1 | 1 | 0 | 1 | 00011101 | 010101 | 2199.7 |
| 30 | $B_{-4}$ | 0 | 0 | 0 | 0 | 1 | 1 | 1 | 0 | 00011110 | 101010 | 2399.2 |

Data regarding $C_{-3}$–$B_{10}$ are omitted

| Address | Tone Pitch | Key Code KC $0_4$ | $0_3$ | $0_2$ | $0_1$ | $N_4$ | $N_3$ | $N_2$ | $N_1$ | Frequency Information $B_{13}\ldots B_6$ | $B_5\ldots B_0$ | Cent Representation |
|---|---|---|---|---|---|---|---|---|---|---|---|---|
| 240 | $C_{10}$ | 1 | 1 | 1 | 1 | 0 | 0 | 0 | 0 | 11110000 | 000000 | 18000 |
| 241 | $C\#_{10}$ | 1 | 1 | 1 | 1 | 0 | 0 | 0 | 1 | 11110001 | 010101 | 18099.7 |
| 242 | $D_{10}$ | 1 | 1 | 1 | 1 | 0 | 0 | 1 | 0 | 11110010 | 101010 | 18199.2 |
| 244 | $D\#_{10}$ | 1 | 1 | 1 | 1 | 0 | 1 | 0 | 0 | 11110100 | 000000 | 18300 |
| 245 | $E_{10}$ | 1 | 1 | 1 | 1 | 0 | 1 | 0 | 1 | 11110101 | 010101 | 18399.7 |
| 246 | $F_{10}$ | 1 | 1 | 1 | 1 | 0 | 1 | 1 | 0 | 11110110 | 101010 | 18499.2 |
| 248 | $F\#_{10}$ | 1 | 1 | 1 | 1 | 1 | 0 | 0 | 0 | 11111000 | 000000 | 18600 |
| 249 | $G_{10}$ | 1 | 1 | 1 | 1 | 1 | 0 | 0 | 1 | 11111001 | 010101 | 18699.7 |
| 250 | $G\#_{10}$ | 1 | 1 | 1 | 1 | 1 | 0 | 1 | 0 | 11111010 | 101010 | 18799.2 |
| 252 | $A_{10}$ | 1 | 1 | 1 | 1 | 1 | 1 | 0 | 0 | 11111100 | 000000 | 18900 |
| 253 | $A\#_{10}$ | 1 | 1 | 1 | 1 | 1 | 1 | 0 | 1 | 11111101 | 010101 | 18999.7 |
| 254 | $B_{10}$ | 1 | 1 | 1 | 1 | 1 | 1 | 1 | 0 | 11111110 | 101010 | 19099.2 |
| 255 | $B_{10}+$ | 1 | 1 | 1 | 1 | 1 | 1 | 1 | 1 | 11111111 | 111111 | 19198.9 |

Speed Control Signal Generator 3

One example of the speed control signal generator 3 is shown in FIG. 3. As shown, it comprises a variable resistor 30, a voltage control type variable frequency oscillator (VCO) 31 with its oscillation frequency controlled by the variable resistor 30 and a differentiating circuit 32 which differentiates an output signal CP of the VCO 31 to form a differentiated pulse having the same period as the period $\Delta t$ of the signal CP and outputs this differentiated signal as a speed control signal CKP. Accordingly, when the slidable contact of the variable resistor 30 is set to a position along a scale corresponding to a desired pitch varying speed, a speed control signal CKP can be obtained having a period corresponding to the set position along the scale.

Unit Variation Width Information Generator 4

Figure 4:
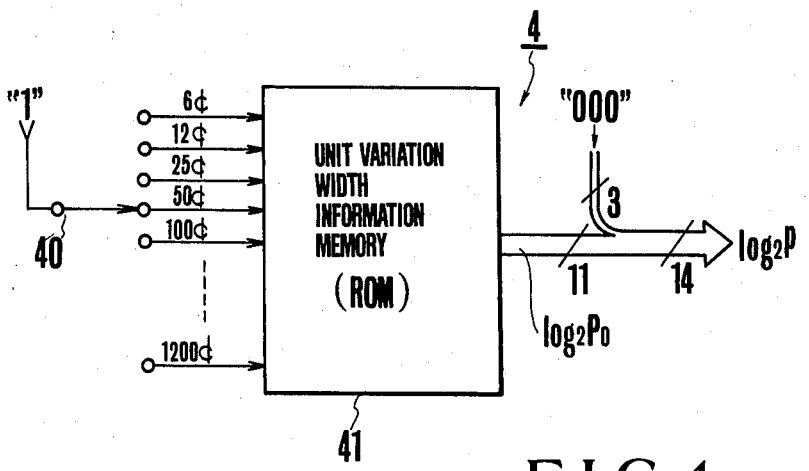
FIG. 4 is a connection diagram showing the detail of one example of the unit variation width information generator shown in FIG. 1.

One example of the unit variation width information generator 4 is shown in FIG. 4. As shown it comprises a transfer switch 40 having stationary or address signal input terminals marked with scale representations 6¢, 12¢, 25¢ . . . 1200¢ (where ¢ designates a cent), and a unit variation width information memory device 41 (ROM) which stores in storage positions corresponding to respective adresses unit variation width informations log $_2$PO corresponding to respective scale representations of the transfer switch 40, the most significant bit and the least significant bit of each information being added with weights to become 1200 cents and 1.2 cents, respectively as shown in the following Table III. Accordingly when the movable contact of the transfer switch 40 is thrown to a stationary contact at a 25¢ scale position, for example a unit variation width information log $_2$PO of "00000010110" will be read out from the memory device 41, and the read out unit variation width information log $_2$PO having a total of 11 bits is always added with "000" to the upper orders for the purpose of making the unit variation width information thus read out and having a total of 11 bits and the frequency information log $_2$F outputted from the frequency information generator 2 to have the same number of bits, thus producing a unit variation information log $_2$P having a total of 14 bits.

TABLE III

| | Bit | | | | | | | | | | |
|---|---|---|---|---|---|---|---|---|---|---|---|
| | (MSB) $B_{10}$ | $B_9$ | $B_8$ | $B_7$ | $B_6$ | $B_5$ | $B_4$ | $B_3$ | $B_2$ | $B_1$ | (LSB) $B_0$ |
| Log $_2$PO (cent representation) | Weight (cent) | | | | | | | | | | |
| | 1200 | 600 | 300 | 150 | 75 | 37.5 | 18.8 | 9.4 | 4.7 | 2.3 | 1.2 |
| 6¢ | 0 | 0 | 0 | 0 | 0 | 0 | 0 | 0 | 1 | 0 | 1 |
| 12¢ | 0 | 0 | 0 | 0 | 0 | 0 | 0 | 1 | 0 | 1 | 0 |
| 25¢ | 0 | 0 | 0 | 0 | 0 | 0 | 1 | 0 | 1 | 1 | 0 |
| 50¢ | 0 | 0 | 0 | 0 | 0 | 1 | 0 | 1 | 0 | 1 | 1 |
| 100¢ | 0 | 0 | 0 | 0 | 1 | 0 | 1 | 0 | 1 | 0 | 1 |
| 200¢ | 0 | 0 | 0 | 1 | 0 | 1 | 0 | 1 | 0 | 1 | 1 |
| 300¢ | 0 | 0 | 1 | 0 | 0 | 0 | 0 | 0 | 0 | 0 | 0 |
| 400¢ | 0 | 0 | 1 | 0 | 1 | 0 | 1 | 0 | 1 | 0 | 1 |
| 600¢ | 0 | 1 | 0 | 0 | 0 | 0 | 0 | 0 | 0 | 0 | 0 |
| 800¢ | 0 | 1 | 0 | 1 | 0 | 1 | 0 | 1 | 0 | 1 | 1 |
| 1200¢ | 1 | 0 | 0 | 0 | 0 | 0 | 0 | 0 | 0 | 0 | 0 |

Calculating Circuit 6

Figure 5:
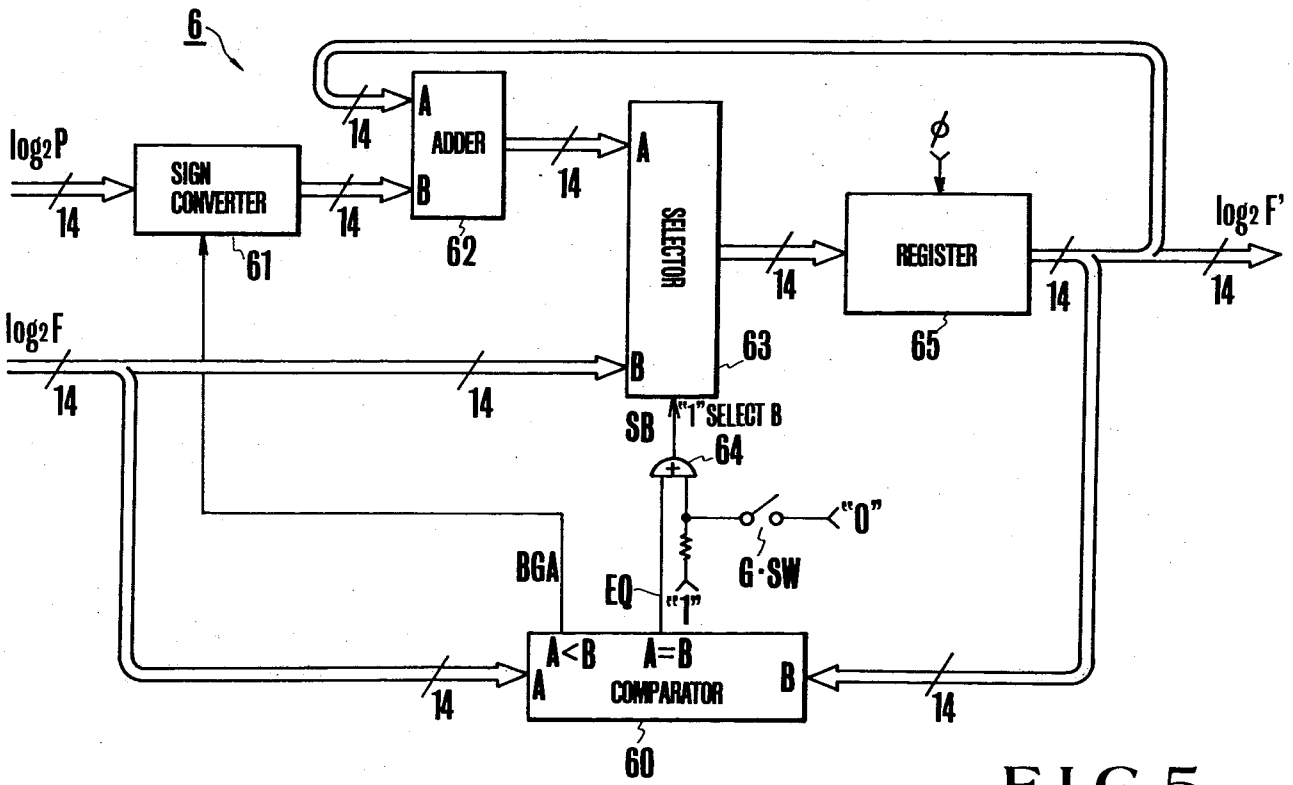
FIG. 5 is a connection diagram showing the detail of one example of the calculating circuit shown in FIG. 1.

One example of the construction of the calculating circuit 6 is shown in FIG. 5.

As shown, it comprises a comparator 60 which compares the frequency information log $_2$F supplied from the frequency information generator 2 with a modified frequency information log $_2$F′ outputted from a register 65 to be described later. The frequency information log $_2$F is supplied to an A input of the comparator 6*c* and the modified frequency information log $_2$F′ is supplied to a B input. When log $_2$F=log $_2$F′, that is when the information log $_2$F′ coincides with the information log $_2$F that is a targert value, the comparator 60 produces a coincidence signal EQ of "1" whereas when log $_2$F<-log $_2$F′, that is when the information log $_2$F′ is larger than the information log $_2$F, that is the target value, the comparator 60 produces an output signal BGA of "1" showing this fact. This output signal BGA is utilized as a sign conversion controlling signal for making negative the unit variation width information log $_2$P.

There are also provided a sign converter 61 which produces the unit variation width information log $_2$P as it is when the output signal BGA is "0", whereas when this signal is "1" connects the unit variation width information log $_2$P into a negative value, an adder 62 which adds the unit variation width information log $_2$P (or −log $_2$P) outputted from the code converter 61 to the modified frequency information log $_2$F′ outputted from the registor 65, and a selector 63 which selects and outputs the frequency information log $_2$F applied to its B input when a selection control signal SB is "1", whereas selects and outputs either one of the outputs of the adder 62, i.e., log $_2$F′+log $_2$P and log $_2$F′−log $_2$P when a selection control signal SB of "0" is applied to its A input. The selection control signal SB is supplied from an OR gate circuit 64.

The OR gate circuit 64 produces a selection control signal SB of "1" when a glissando effect designation switch GSW that designates whether the glissando effect is to be imparted or not is open (not to impart the glissando effect), and when a coincidence signal EQ of "1" showing the coincidence of the frequency information log $_2$F from the comparator 60 with the modified frequency information log $_2$F′ is outputted.

Also a register 65 is provided for storing and holding the output information from the selector 63 and the register 65 is driven by a clock pulse $\phi$ having an extremely short period. After delaying the output information from the selector 63 by a time (one bit time) corresponding to one period of the clock pulse $\phi$, the register 65 output this delayed information as the next new modified frequency information log $_2$F′.

With the calculating circuit 6 described above when the glissando effect designation switch G·SW is closed to specify imparting of the glissando effect, and when the unit variation width information log $_2$P is supplied at each period $\Delta t$ of the speed control signal CKP, the code converter 61 controls the sign with the information log $_2$P according to the designation of the output signal BGA. Suppose now that a new key of the keyboard is depressed and a frequency information log $_2$F (in this example log $_2$F≠0) corresponding to the new key is inputted to the calculating circuit 6 from the frequency information generator 2 (FIG. 1) and that the modified frequency information log $_2$F′ now being produced by the register 63 i.e. equal to zero, the comparator 60 produces an output signal BGA of "0" showing that log $_2$F>log $_2$F′. Consequently, the sign converter 61 applies to the adder 63 the unit variation width information log $_2$P supplied at each period $\Delta t$ of the speed control signal CKP without changing the sign of the information log $_2$P to negative.

Then the adder 62 adds together the modified frequency information log $_2$F′ outputted from the register 65 and the unit variation width information log $_2$P and supplies their sum ($\log_2 F' + \log_2 P$) to the selector 63. At this time, the coincidence signal EQ produced by the comparator 60 is "0" because $\log_2 F > \log_2 F'$, and the selection control signal SB outputted from the OR gate circuit 64 is also "0". Accordingly, the selector 63 selects the information ($\log_2 F' + \log_2 P$) outputted from the adder 62 and applied to the A input and supplies the selected information to the register 65, whereby a new information ($\log_2 F' + \log_2 P$) is applied to the register 65 and this new information is outputted one bit time later. Denoting this time by $t_o$, the register 65 produces the information ($\log_2 F' + \log_2 P$) as the present value $\log_2 F'$ of the modified frequency information $\log_2 F'$ ($t_o$) at time $t_o$. If the gate circuit 5 is disabled immediately after time $t_o$ so that the unit variation width information $\log_2 P$ is not supplied, the output information of the adder becomes ($\log_2 F'(t_o) = 0$) and the register 65 holds the value $\log_2 F'$ ($t_o$) at this time. Consequently, it is necessary to set the interval in which the unit variation width information $\log_2 P$ is sent out to coincide with one bit time, that is the delay time of register 65.

At a time $t_1$ at which a next speed control signal is generated, when the gate circuit 5 (FIG. 1) supplies again the unit varying width information, the code converter 62 supplies the unit variation width information $\log_2 P$ as it is so long as the output signal BGA of the comparator is "0", in other words $\log_2 F > \log_2 F'$ ($t_o$). *Then the adder* 62 *adds the modified frequency information log* $_2F'$ ($t_o$) now being outputted from the register 65 to the unit variation width information $\log_2 P$ and applies their sum ($\log_2 F'$ ($t_o$) $= \log_2 P$) to the selector 63 which selects this sum and applies the same to the register 65 so long as a selection control signal SB is "0". Consequently, the register 65 produces this new information ($\log_2 F'$ ($t_o$) $+ \log_2 P$) as the present value $\log_2 F'$ ($t_1$) of the modified frequency information at time $t_1$.

Above described operations are repeated, and when it becomes $\log_2 F = \log_2 F'$ ($t_{10}$) at time $t_{10}$ for example, the comparator 60 produces a coincidence signal EQ showing this fact. The coincidence signal EQ is applied to the selector 63 as a selection signal SB via the OR gate circuit 64. Then, the selector 63 selects its B side input and thereafter continuously supplies to the register 65 the frequency information $\log_2 F$ regarding a key now being depressed until the frequency information $\log_2 F$ regarding a newly depressed key is applied. Consequently, after time $t_{10}$, the register 65 continuously outputs the frequency information $\log_2 F$ regarding the depressed key as a modified frequency information $\log_2 F'$.

In other words, when a frequency information $\log_2 F$ regarding the newly depressed key is given the register 65 produces the modified frequency information $\log_2 F'$ which varies sequentially with time until it coincides with the frequency information $\log_2 F$ regarding the newly depressed key, starting from an initial value, that is the frequency information $\log_2 F$ corresponding to a previously depressed key, at a speed of variation corresponding to the period of the speed control signal and with a pitch variation width represented by the unit variation width information $\log_2 P$. After the modified frequency information $\log_2 F'$ comes to coincide with a target value, that is the frequency information $\log_2 F$ regarding the newly depressed key, this frequency information (without modification) is continuously outputted as the modified frequency information $\log_2 F'$ until a frequency information $\log_2 F$ regarding the next newly depressed key is produced.

As a consequence, when a key is depressed and under a condition in which modified frequency information $\log_2 F'$ outputted from the register 65 satisfies a relation $\log_2 F' < \log_2 F$ a modified frequency information $\log_2 F'$ is obtained which gradually increases toward a target value, that is $\log_2 F$ with a pitch variation width of the unit variation information $\log_2 P$ and at a variation speed corresponding to the period of the speed control signal CKP. Where the modified frequency information $\log_2 F'$ outputted from the register 65 satisfies a relation $\log_2 F' > \log_2 F$, when a key is depressed, since the output signal BGA produced by the comparator 60 remains at "1" until a relation $\log_2 F' = \log_2 F$ is satisfied, a unit variation width information ($-\log_2 F$) with its sign changed to negative would be applied to the adder 62.

Thus, a modified frequency information $\log_2 F'$ can be obtained which gradually decreases at a variation speed corresponding to the period of the speed control signal CKP and with a variation width of ($-\log_2 P$) until a target value, that is the frequency information $\log_2 F$ is reached.

Since the selection control signal SB of "1" is normally applied to the selector 63 from the OR gate circuit 64, when the glissando effect designation switch G·SW is OFF (opened), the selector 63 continues to select and outputs the frequency information $\log_2 F$ corresponding to the depressed key. As a consequence, the modified frequency information $\log_2 F'$ outputted from the register 65 in this case does not vary with time, with the result that the tone pitch of the generated musical tone does not vary with time. In other words, no glissando effect is imparted.

Figure 6:
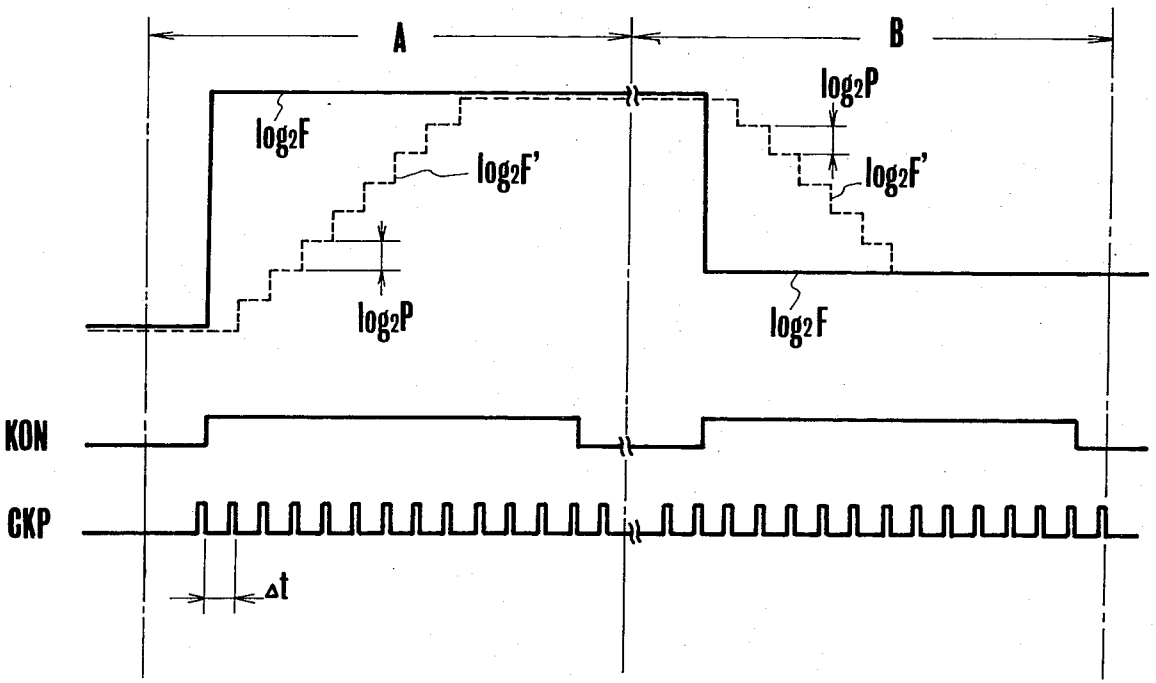
FIG. 6 is a time chart showing the manner of varying the modified frequency information $\log_2 F'$ outputted from the calculating circuit shown in FIG. 5.

FIG. 6 is a time chart showing the manner of variation of the modified frequency information $\log_2 F'$ in which a region A shows a case wherein the frequency information $\log_2 F$ regarding a newly depressed key and the modified frequency information $\log_2 F'$ outputted from the register 65 at a time when the information $\log_2 F$ is given satisfy a relation $\log_2 F > \log_2 F'$, whereas a region B shows a case wherein an opposite relation $\log_2 F < \log_2 F'$ is satisfied. For this reason, where a musical tone signal is formed by utilizing the modified frequency information $\log_2 F'$ in the region A, it is possible to obtain a up going glissando effect in which the pitch gradually increases, whereas when a musical tone signal is formed by utilizing the modified frequency information $\log_2 F'$ in the region B, a down going glissando effect can be obtained in which the tone pitch decreases gradually.

LLC 7

The LLC 7 is constituted by a ROM (read only memory device) and values of $F' = 2Z$ are stored in the respective addresses of the ROM so that when a modified frequency information $\log_2 F'$ expressed as a logarithm is applied as an address information, a modified frequency information F' expressed by a natural number can be read out.

Musical Tone Signal Generator 8

Figure 7:
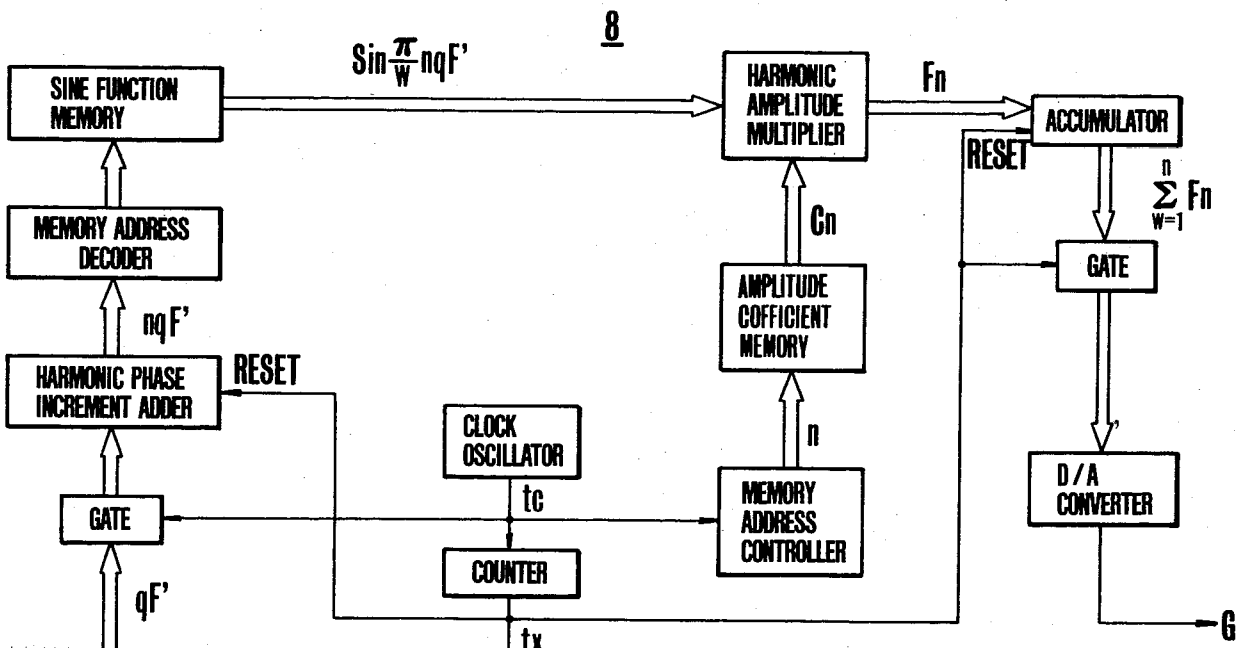
FIG. 7 is a block diagram showing one example of the musical tone signal generator shown in FIG. 1.

The musical tone signal generator 8 is constructed to form a musical tone according to a harmonic synthesizing system as shown in FIG. 7, for example.

More particularly, based on a frequency information F', a fundamental wave corresponding thereto and harmonic components $$\left(\sin \frac{\pi}{w} nqF'\right)$$

are formed on a time division basis, desired amplitude coefficients $C_n$ are multiplied with respective harmonic components and then the multiplied values are synthesized to form a musical tone.

Such method of forming a musical tone by the synthesis of harmonic components is described in Japanese Publication of Patent No. 12172, 1978 so that it will not described here in detail.

Of course, in addition to the harmonic synthesizing system mentioned hereinabove, the musical tone signal generator 8 may be constituted by a waveform memory device or a synthesizer system.

Modified Frequency Information Generator 2

Figure 8:
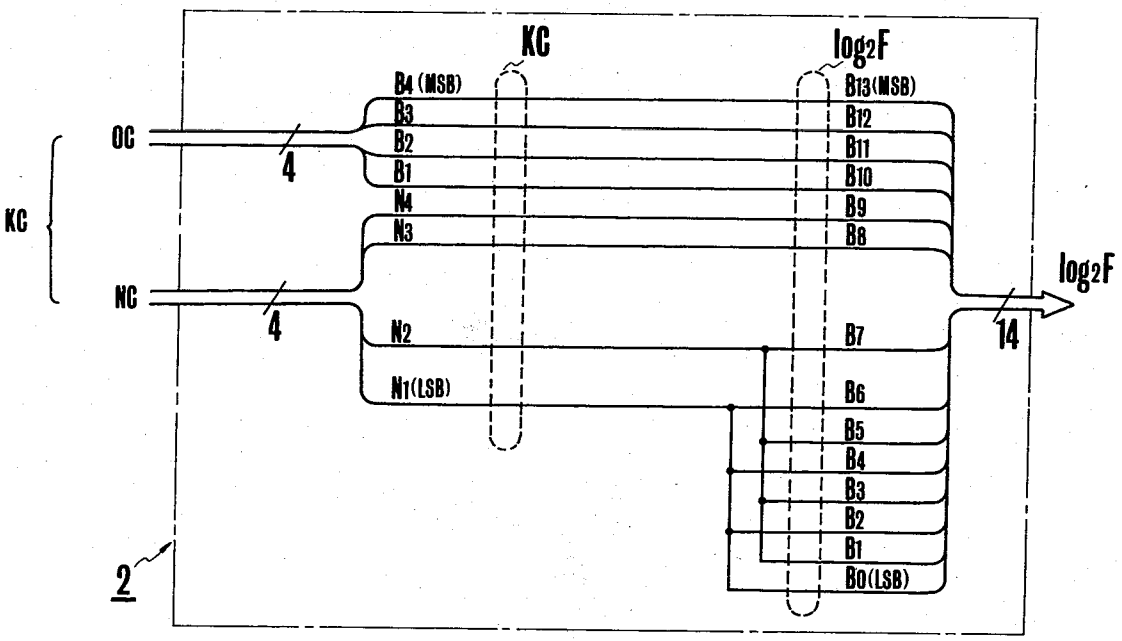
FIG. 8 is a connection diagram showing a modification of the frequency information generator shown in FIG. 1.

FIG. 8 is a connection diagram showing a modified embodiment of the frequency information generator 2 which is constructed to repeatedly add three times the lower order two bits N2 and N1 of the note code NC (N4 to N1) of a key code KC produced by the keyboard circuit 1 to a bit lower than the least significant bit N1 of the note code NC to obtain a frequency information $\log_2 F$ shown in Table II*a*.

More particularly, in this modification, an 8 bit key code is inputted, and the lower order two bits N2 and N1 of the note code NC of the key code are repeatedly added three times to an order lower than the least significant bit N1 of the note code NC, to obtain 14 bit outputs as shown in the following Table IV. Predetermined weights are applied to respective bits $B_{13}$ and $B_0$ of the output as shown in Table II*a* to produce logarithmic frequency information $\log_2 F$ with an extremely simple construction.

TABLE IV

| Output | $B_{13}$ | $B_{12}$ | $B_{11}$ | $B_{10}$ | $B_9$ | $B_8$ | $B_7$ | $B_6$ | $B_5$ | $B_4$ | $B_3$ | $B_2$ | $B_1$ | $B_0$ |
|---|---|---|---|---|---|---|---|---|---|---|---|---|---|---|
| Input | OC | | | | NC | | | | | | | | | |
| | $O_4$ | $O_3$ | $O_2$ | $O_1$ | $N_4$ | $N_3$ | $N_2$ | $N_1$ | $N_2$ | $N_1$ | $N_2$ | $N_1$ | $N_2$ | $N_1$ |

An information obtained by repeatedly adding three times the lower order two bits N2 and N1 of the note code NC to an order lower than the least significant bit N1 of the note code NC coincides with the logarithmic frequency information $\log_2 F$ for the following reason.

In the case of temperament, the frequency ratio between adjacent tone pitches has a relation of 2 1/12 times, and the frequency ratio $\alpha_k$ of the kth tone pitch reference to a reference tone pitch is expressed by the following equation.

$$\alpha_k = 2k/12 \tag{5}$$

That is $$\log_2 \alpha_k = k/12 \tag{6}$$

On the other hand, the number of the tone pitches, that is the note contained in each octave is 12 and at least 4 bits are necessary to represent these 12 notes (C, C#, . . . B) by digital data.

In the case of 4 bit data, the number of their truth values is $16(2^4)$ consisting of "0000" through "1111". When assigning 12 note name to these 16 truth values it is desirable to assign such that the spacings between digits of the truth values assigned with respective note name will have equal ratio spacing. Because as above described the frequency ratio between notes is always 2 1/12, that is an equal ratio spacing.

Taking 4 bit (N4, N3, N2, N1) data as a decimal portion, when the lower two order bits N2 and N1 of this data are infinitely and repeatedly added to an order lower than the least significant bit N1 of the data the convergent values of the binary values will be shown by the following Table V, where the data represented by the entire bits after the addition are takken as binary values. Since the convergent values shown in Table V can be obtained by utilizing a general equation $$S_{28} = a/(1-q)$$

regarding the sum of an infinite geometric series the description thereof is not be made herein. In the above equation a represents the initial term, and q a common ratio.

As a consequence, taking four bit data (N4, N3, N2, N1) as a decimal portion when the lower order two bits N1 and N2 are infinitely and repeatedly added to an order lower than its least significant bit N1, as can be noted from Table V, when the data N4 to N1 are (a) "0011" and "0100", (b) "0111" and "1000", (c) "1011" and "1100" and (d) "1111" and "0000" all of them become the same convergent value. For this reason it may be considered that "0011" and "0111" and "1000", "1011" and "1100" and "1111" and "0000" are the same. As a consequence, it is possible to decrease the number of the truth values from 16 to 12.

Thus, when 12 notes are assigned to 12 truth values as shown in Table V, the spacings between adjacent truth values assigned with respective notes becomes substantially equal ratio and their relation of the convergent value coincides with that shown in equation (6).

By repeatedly adding the lower order two bits N2 and N1 of a four bit note code NC assigned with each note to an order lower than the least significant bit N1 as shown by Table I*b*, (the data thus added with bits are hereinafter called note data) it will be understood that the value of the note data (convergent value) represents the value of $\log_2 \alpha_k$ shown in equation (6). For example, the note name D corresponds to the second (k=2) note name with respect to the reference note name C and the frequency ratio $\alpha_2$ between the note names C and D can be derived out as $\log_2 \alpha_2 = 2/12$ from equation (6).

This value 2/12 coincides with the convergent value of the note data regarding note name D shown in Table V.

As the octave becomes higher, k in equation (6) increases as 12, 13, 14 . . . , the value k/12 on the righthand side of equation (6) increases in the form of a mixed fraction. Consequently when the octave code OC is combined as an integer portion to the note data comprising the decimal portion, the value of the combination becomes $\log_2 \alpha_k$, which is equivalent to a logarithm of the frequency of all tone pitches, taking 2 as the base. From this it can be noted that the data obtained by repeatedly adding the lower order two bits N2 and N1 of a key code to an order lower than its least significant bit N1 represents a logarithm of a value corresponding to the frequency of each tone pitch, that is the frequency information $\log_2 F$.

Actually, however, it is almost impossible to infinitely and repeatedly add the lower order two bits N2 and N1 of the note code to an order lower than the least significant bit thereof. Accordingly, according to this embodiment the addition operation is repeated only three times so as to obtain a frequency information $\log_2 F$ ($=\log_2 \alpha_k$) having a total of 14 bits. It can be readily understood that the frequency information $\log_2 F$ obtained from the circuit shown in FIG. 8 coincides with the frequency information shown in Table IIb.

means of a newly added adder 11, and their sum ($\log_2 F' + \log_2 V$) is applied to LLC 7 to be converted into a natural number frequency information (F'V).

Figures 9, 11:
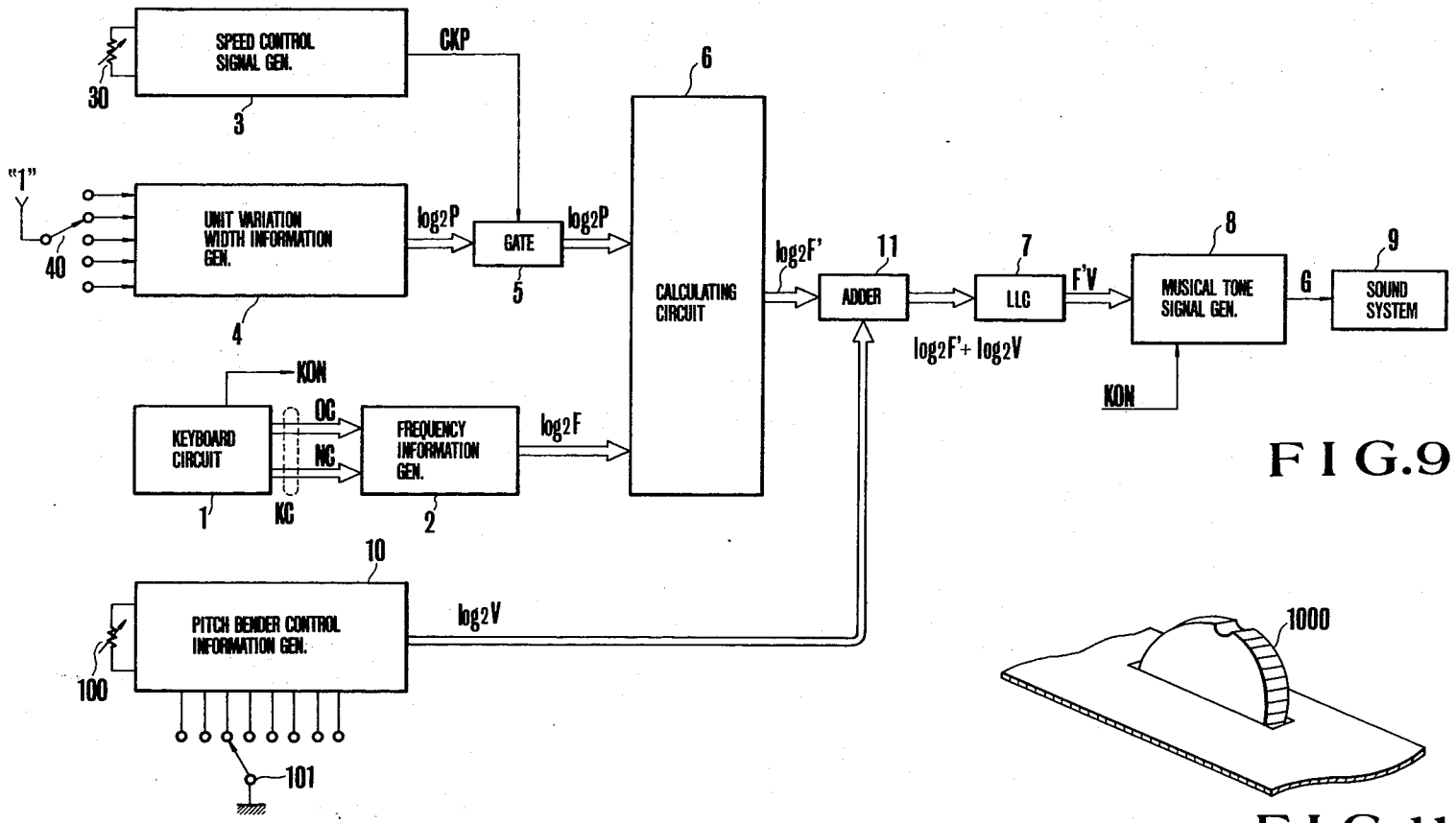
FIG. 9 is a block diagram showing a modified embodiment of the musical instrument according to this invention.
FIG. 11 is a perspective view showing one example of a rotary knob for the pitch bender.
Figure 10:
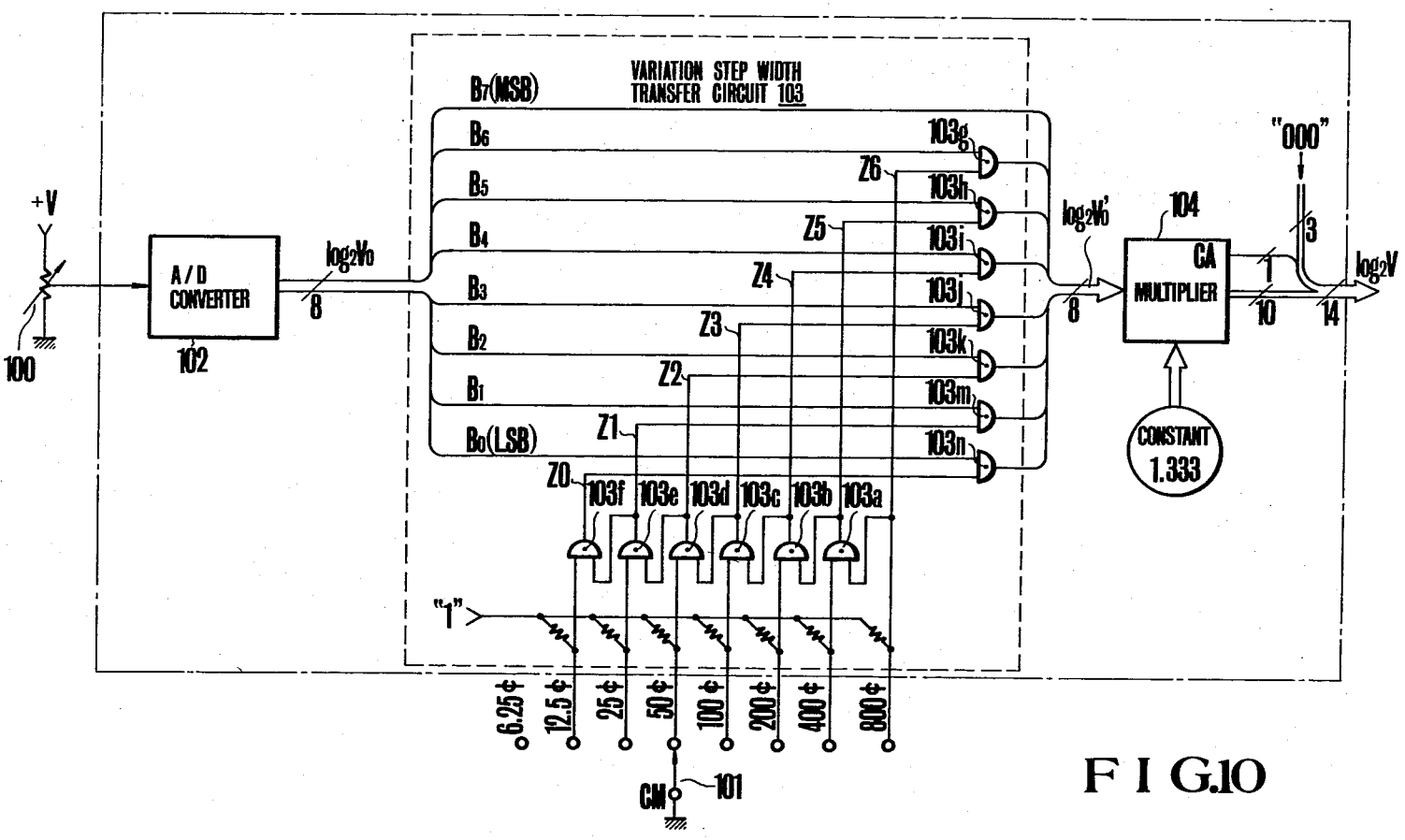
FIG. 10 is a connection diagram showing the detail of one example of the control information generator for the pitch bender shown in FIG. 9.

Pitch bending information controller 10 is constructed as shown in FIG. 10, for example. The variable resistor 100 comprises a slidable element operated by a rotary knob 1000 shown in FIG. 11 to any desired position along a scale graduated with 0 cent through 1593.75 cents for generating a continuously varying voltage acting as the pitch bending information. The rotary knob 1000 is constructed such that when it is released after rotating its recess to a desired cent position it automatically rotate back to the 0 cent position.

TABLE V

| Decimal portion | | | | | | | | | | | | | | Convergent | | Assignment |
|---|---|---|---|---|---|---|---|---|---|---|---|---|---|---|---|---|
| $N_4$ | $N_3$ | $N_2$ | $N_1$ | $N_2$ | $N_1$ | $N_2$ | $N_1$ | $N_2$ | $N_1$ | $N_2$ | $N_1$ | $N_2$ | $N_1$... | value | Remark | of tones |
| 0 | 0 | 0 | 0 | 0 | 0 | 0 | 0 | 0 | 0 | 0 | 0 | 0 | 0... | $\frac{0}{12}$ | | C |
| 0 | 0 | 0 | 1 | 0 | 1 | 0 | 1 | 0 | 1 | 0 | 1 | 0 | 1... | $\frac{1}{12}$ | | C# |
| 0 | 0 | 1 | 0 | 1 | 0 | 1 | 0 | 1 | 0 | 1 | 0 | 1 | 0... | $\frac{2}{12}$ | | D |
| 0 | 0 | 1 | 1 | 1 | 1 | 1 | 1 | 1 | 1 | 1 | 1 | 1 | 1... | $\frac{3}{12}$ | | not used |
| 0 | 1 | 0 | 0 | 0 | 0 | 0 | 0 | 0 | 0 | 0 | 0 | 0 | 0... | $\frac{3}{12}$ | same | D# |
| 0 | 1 | 0 | 1 | 0 | 1 | 0 | 1 | 0 | 1 | 0 | 1 | 0 | 1... | $\frac{4}{12}$ | | E |
| 0 | 1 | 1 | 0 | 1 | 0 | 1 | 0 | 1 | 0 | 1 | 0 | 1 | 0... | $\frac{5}{12}$ | same | F |
| 0 | 1 | 1 | 1 | 1 | 1 | 1 | 1 | 1 | 1 | 1 | 1 | 1 | 1... | $\frac{6}{12}$ | | not used |
| 1 | 0 | 0 | 0 | 0 | 0 | 0 | 0 | 0 | 0 | 0 | 0 | 0 | 0... | $\frac{6}{12}$ | same | F# |
| 1 | 0 | 0 | 1 | 0 | 1 | 0 | 1 | 0 | 1 | 0 | 1 | 0 | 1... | $\frac{7}{12}$ | | G |
| 1 | 0 | 1 | 0 | 1 | 0 | 1 | 0 | 1 | 0 | 1 | 0 | 1 | 0... | $\frac{8}{12}$ | | G# |
| 1 | 0 | 1 | 1 | 1 | 1 | 1 | 1 | 1 | 1 | 1 | 1 | 1 | 1... | $\frac{9}{12}$ | | not used |
| 1 | 1 | 0 | 0 | 0 | 0 | 0 | 0 | 0 | 0 | 0 | 0 | 0 | 0... | $\frac{9}{12}$ | same | A |
| 1 | 1 | 0 | 1 | 0 | 1 | 0 | 1 | 0 | 1 | 0 | 1 | 0 | 1... | $\frac{10}{12}$ | | A# |
| 1 | 1 | 1 | 0 | 1 | 0 | 1 | 0 | 1 | 0 | 1 | 0 | 1 | 0... | $\frac{11}{12}$ | | B |
| 1 | 1 | 1 | 1 | 1 | 1 | 1 | 1 | 1 | 1 | 1 | 1 | 1 | 1... | $\frac{12}{12}$ | | not used |

Another Embodiment of the Electronic Musical Instrument

FIG. 9 shows another embodiment of the electronic musical instrument according to this invention which is identical to that shown in FIG. 1 except that a circuit for imparting a pitch bender effect is added, so that elements corresponding to those shown in FIG. 1 are designated by the same reference charactors, and only a portion different from FIG. 1 will be described in detail.

More particularly, there is added a pitch bender control information generator 10 which generates a control information for varying the pitch of a pitch bender effect and is constructed such that the pitch bender control information $\log_2 V$ generated thereby varies stepwisely following the movement of the slidable element of a variable resistor 100 with a pitch variation width corresponding to the stationary contacts of a transfer switch 101. This pitch bending control signal $\log_2 V$ is added to the modified frequency information $\log_2 F'$ outputted from the calculating circuit 6 by The transfer switch 101 sets any desired variation step width (unit variation width) of the pitch bending information which varies continuously following the rotation of the rotary knob 1000. In the embodiment, the transfer switch 101 is constructed such that the pitch variation step width can be set to any one of 6.25 cents, 12.5 cent, 25 cents, 50 cents, 100 cents, 200 cents, 400 cents, and 800 cents, and is provided with 8 stationary contacts labelled with the variation step widths of 6.25 cents through 800 cents An analog to digital converter 102 is used for converting an analog voltage signal derived out through the slidable contact of the variable resistor 100 into a digital pitch bending control information $\log_2 Vo$ which comprises 8 bits. Respective bits $B_7$ to $B_0$ are applied with a weights to have values as shown in the following Table VI.

TABLE VI

| Bit | Cent Value |
|---|---|
| $B_7$ (MSB) | 600 |

TABLE VI-continued

| | Bit | Cent Value |
|---|---|---|
| Pitch bending information log $_2$Vo | $B_6$ | 300 |
| | $B_5$ | 150 |
| | $B_4$ | 75 |
| | $B_3$ | 37.5 |
| | $B_2$ | 18.8 |
| | $B_1$ | 9.4 |
| | $B_0$ (LSB) | 4.7 |

The range of pitch variation that can be represented by the pitch bending control information log $_2$Vo outputted from the A/D converter 102 is from 1195.4 cents. On the other hand, the scale graduation of the rotary knob 1000 ranges from 1593.75–0 cents. Thus, although these ranges do not coincide with each other, the information log $_2$V is multiplied with 1.333 by a multiplier 104 to be described later so that it becomes to coincide with the graduation. Accordingly, the weights added to respective bits of the pitch bending control information log $_2$Vo are 1.333 times of the cent values shown in Table VI, because by making the weight added to the bit B4 to correspond to 100 cents the switching control of the switching of the variation step width of the pitch bender effect can be made advantageously as will be described later.

There is also provided a variation step width transfer circuit 103 for switching the variation step width of the pitch bending control information log $_2$Vo outputted from the A/D converter 102. The transfer circuit 103 is provided with AND gate circuits 103*a* to 103*f* and 103*g* to 103*n* which prevent sending out of the bits of the information log $_2$Vo corresponding to cent values less than the cent values shown at respective stationary contacts of the transfer switch 101. For example, when the movable contact CM is thrown to a stationary contact labelled with 50 cents as shown in FIG. 10, the output signals Z2, Z1 and Z0 of AND gate circuits 103*d*, 103*e* and 103*f* are all "0" so that even when the bits B2, B1 and B0 of the information log $_2$Vo are all "1", these "1" signals are inhibited from passing through the AND gate circuits 103*k* to 103*n*. Thus information less than 37.5 cents among informations log $_2$Vo are discarded. For this reason, the variation step width that can be represented by the pitch bending control information log $_2$Vo is equal to 37.5 cents. Actually, the information log $_2$Vo whose variation step width has been switched in this manner is applied to a multiplier 104 to be decribed hereinafter as an information log $_2$Vo' to be multiplied with 1.333 so that the variation step width that can be represented by the pitch bending control information ultimately outputted becomes equal to 50 cents. Thus, the labels (6.25 to 800 cents) applied to the stationary contacts of the transfer switch 101 represent the variation step widths that can be represented by the pitch bending control information log $_2$V.

As above described the multiplier 104 multiplies the pitch bending control information log $_2$Vo' produced by the variation step width transfer switch 103 with 1.333 and the product thereof is expressed by 9 bit integer portion and 2 bits decimal portion, including a carry. A three bit information "000" is added to the most significant bit of the resulting 11 bit product to form a pitch bending control information log $_2$V consisting of a total of 14 bits.

The purpose of adding the three bit information "000" is to make the total number of bits of the information log $_2$V to be equal to the number of bits of the frequency information log $_2$F produced by the frequency information generator 2.

Thus, the pitch bending control information log $_2$V outputted from the pitch bending control information generator 10 has a total of 14 bits and its respective bits $B_{13}$ to $B_0$ are applied with weights similar to those of the frequency information log $_2$F shown in Table IIa.

With the pitch bending control information generator 10 described above, prior to the commencement of the calculation, the transfer switch 101 is operated to select a desired variation step width. Thereafter, during the performance, the rotary knob 1000 is operated.

Suppose now that the movable contact CM of the transfer switch 101 is thrown to the stationary contact labelled with 6.25 cents and that under this condition the rotary knob 1000 is rotated to continuously move the slidable contact of the variable resistor 100 from 0 cent scale position to 1000 cents scale position. Then the A/D converter 102 produces a pitch bending control information log $_2$Vo which gradually varies with a variation width corresponding to 6.25/1.333 cents. Although this pitch bending control information log $_2$Vo is applied to the variation step width transfer circuit 103 since the movable contact CM of the transfer switch 101 has been thrown to the 6.25 cents position, the information log 2Vo is inputted to the multiplier 104 without any modification to be used as the information log 2Vo' and multiplied with 1.333, thus producing the pitch bending control information log 2V which varies as shown by a curve A' in FIG. 12.

When the movable contact CM of the transfer switch 101 is thrown to the 100 cents position and then under this condition when the slidable contact of the variable resistor 100 is continuously moved from 0 cent scale position to 1000 cents scale position by rotating the rotary knob 1000 the A/C converter 102 produces a pitch bending control information log 2Vo which varies stepwisely to a value corresponding to 1000/1.333 cents with a variation step width of 6.25/1.333 cents.

Figure 12:
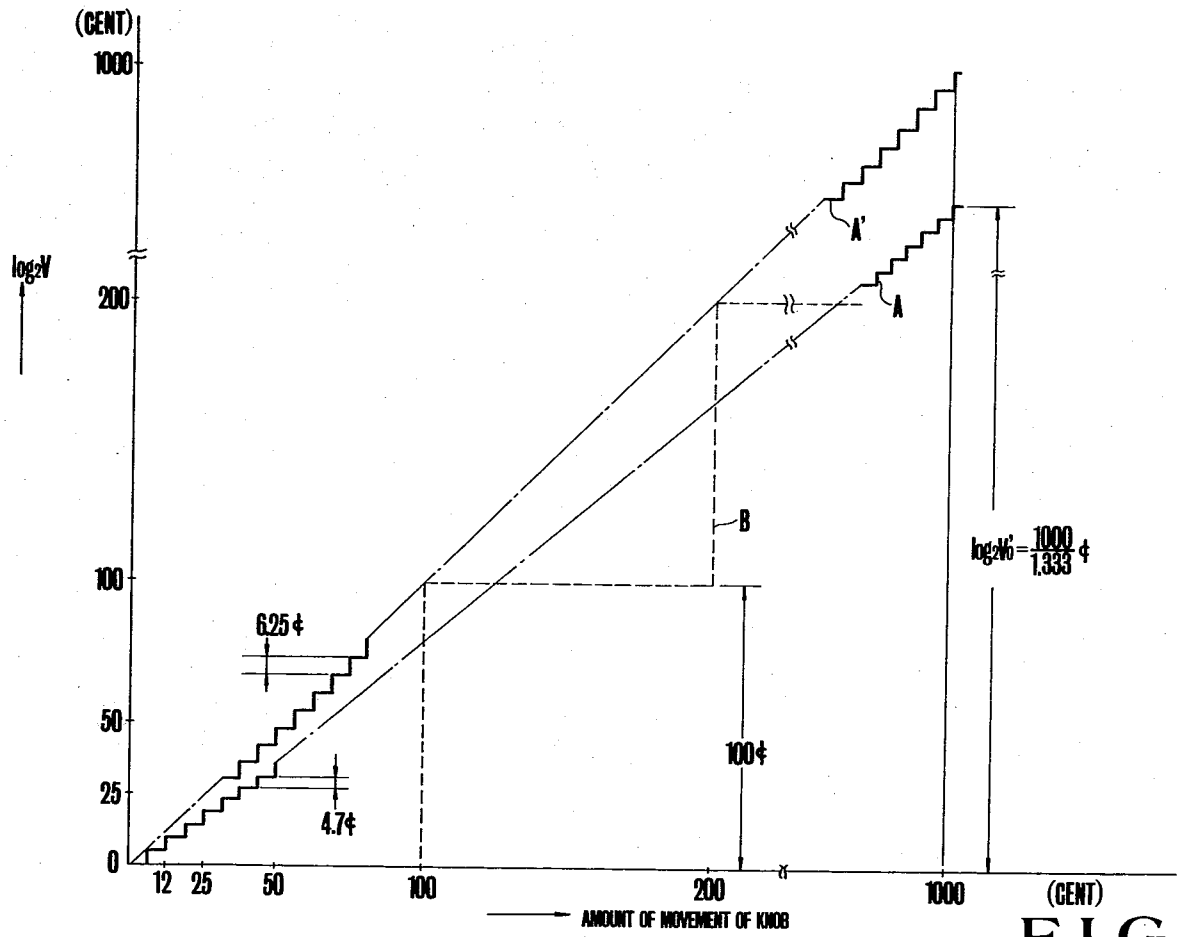
FIG. 12 is a graph showing one example of the manner of varying the pitch bender control information $\log_2 V$ produced by the pitch bender control information generator shown in FIG. 10

This stepwisely varying pitch bending control information log $_2$Vo is applied to the variation step width transfer circuit 103, but since the variation step width has been set to 100 cents by the transfer switch 101 the output signals Z3, Z2, Z1 and Z0 of the AND gate circuits 103*c*, 103*d*, 103*e* and 103*f* are all "0". Accordingly, even when the bits B3, B2, B1 and B0 become "1" when the information log $_2$Vo varies continuously, signals "1" of the lower order bits including bit B3 can not pass through the AND gate circuits 102*j*, 103*k*, 103*m* and 103*n* and only the signals "1" of the bits B6, B5 and B4 can pass through the AND gate circuits 103*g*, 103*h* and 103*i*. In other words, the signals "1" of the bits B3–B0 corresponding to less than 100/1.333 cents are disregarded. Consequently, the pitch bending control information log $_2$Vo' which gradually varies stepwisely to a value corresponding to 1000/1.333 cents with a variation step width corresponding to 100/1.333 is applied to the multiplier 104. Consequently, in this example, a pitch bending control information log $_2$V which varies as shown by curve B in FIG. 12 is outputted.

As a consequence, the pitch bending control information generator 10 can generate a pitch bending control information log $_2$V which varies in a range of from 0 to 1593.5 cents and it is possible to switch the variation step width along 8 steps of from 6.25 cents to 800 cents.

Figure 13:
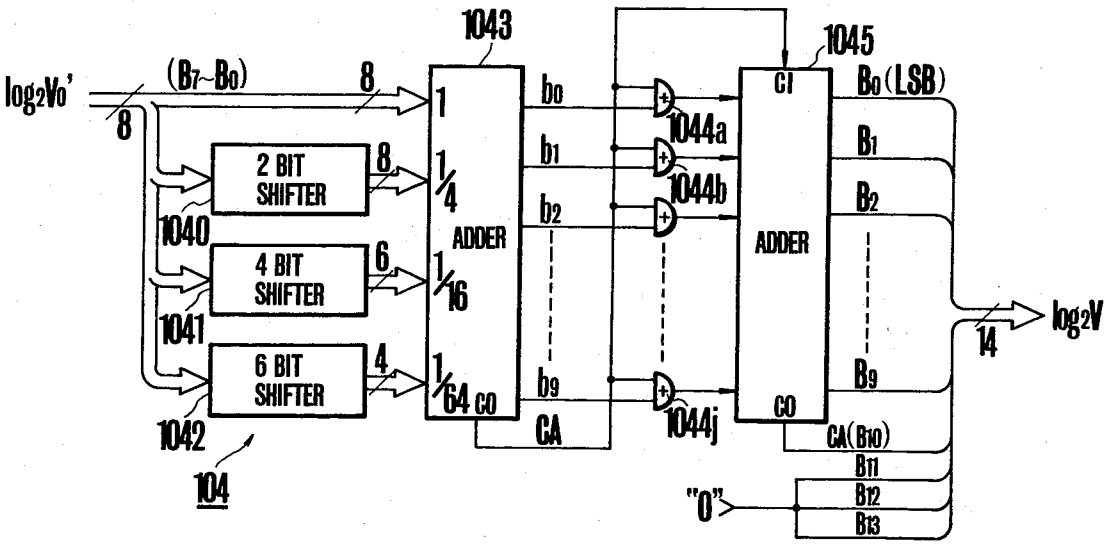
FIG. 13 is a block diagram showing a modification of the multiplier of the pitch bender control information generator shown in FIG. 10.

The multiplier 104 of the pitch bending control information generator 10 of this embodiment may be substituted by a circuit shown in FIG. 13.

FIG. 13 shows a modification of the multiplier 104 shown in FIG. 10 constituted by a first portion comprising a 2 bit shift circuit 1040 for multiplying the pitch bending control information $\log_2 Vo'$ with 1.333, a four bit shift circuit 1041, a 6 bit shift circuit 1042 and an adder 1043; and a second portion comprising OR gate circuits 1044*a* to 1044*j* for limiting the maximum value of the lastly outputted pitch bending control information $\log_2 V$ to 1200 cents, and an adder 1045.

With this construction the 2 bit shift circuit 1040 shifts respective bits B7 to B0 of the pitch bending control information $\log_2 Vo'$ toward the lower orders by 2 bits respectively to form an information $\frac{1}{4}\cdot\log_2 Vo'$ corresponding to $\frac{1}{4}$ of the information $\log_2 Vo'$ and applies the $\frac{1}{4}\cdot\log_2 Vo'$ information to the adder 1043, while the shift circuit 1041 shifts respective bits B7 to B0 of the information $\log_2 Vo'$ toward the lower orders by 4 bits respectively to form an information $1/16\cdot\log_2 Vo'$ corresponding to 1/16 of the information $\log_2 Vo'$ and applies the information $1/16\cdot\log_2 Vo'$ to the adder 1043. In the same manner, the 6 bit shift circuit 1042 shifts respective bits B7 to B0 of the information $\log_2 Vo'$ towards the lower orders by 6 bits respectively to form an information $1/64\cdot\log_2 Vo'$ corresponding to 1/64 of the information $\log_2 Vo'$ and applies the information $1/64\cdot\log_2 Vo'$ to the adder 1043. Also the information $\log_2 Vo'$ is applied directly to the adder 1043. Consequently, an arithmetic operation as shown by the following equation 7 is executed by the adder 1043.

| | | | | | | | | | | | | |
|---|---|---|---|---|---|---|---|---|---|---|---|---|
| $\log_2 Vo'$ | ... | B7 | B6 | B5 | B3 | B2 | B1 | B0 | | | | |
| $\frac{1}{4}\cdot\log_2 Vo'$ | ... | | | B7 | B6 | B5 | B4 | B3 | B2 | B1 | B0 | |
| $1/16\cdot\log_2 Vo'$ | ... | | | | | B7 | B6 | B5 | B4 | B3 | B2 | |
| + $1/64\cdot\log_2$ | ... | | | | | | | B7 | B6 | B5 | B4 | |
| | CA (b10) | b9 | b8 | b7 | b6 | b5 | b4 | b3 | b2 | b1 | b0 | |

where Σ represents the sum obtained by the adder 1043.

Summing equations for respective bits are shown by $$\Sigma = \log_2 Vo' + \tfrac{1}{4}\log_2 Vo' + 1/16\log_2 Vo' + 1/64\log_2 Vo' \quad (7)$$

$$= \frac{85}{64}\log_2 Vo' \cong 1.33\log_2 Vo'$$

Thus, an 11 bit information $1.33\cdot\log_2 Vo'$ utilizing a carry signal CA as the most significant bit b10 can be obtained.

In this case, the weight added to the least significant bit b0 corresponds to 1.2 cents, while the weight added to the most significant bit b10 corresponds to 1200 cents.

The resulting information $1.33\cdot\log_2 Vo'$ corresponding to 1.33 times of the information $\log_2 Vo'$ is applied to the adder 1045 via OR gate circuits 1044*a* to 1044*j* and added to the carry signal outputted from the adder 1043. However, since this carry signal is also applied to the OR gate circuits 1044*a* to 1044*j* the all sum input signals to the adder including the carry input signal become "1" when the information $1.33\cdot\log_2 Vo'$ corresponding to 1.33 times of the information $\log_2 Vo'$ is larger than 1200 cents and when the carry signal CA becomes "1". As a consequence, all bits B0 (LSB) to B9 among the informations outputted from the adder 1045 are "0" and only the carry signal CA is "1". In other words, the maximum value of the information $1.33\cdot\log_2 Vo'$ is limited to a value corresponding to 1200 cents.

Conversely, when the information $\log_2 Vo'$ corresponds to a value less than 1200 cents, the information $1.33\cdot\log_2 Vo'$ outputted from the adder 1043 is outputted as it is without being modified by the adder 1045. Respective bits including the carry signal CA outputted from an adder 1045 are produced as a pitch bending control information $\log_2 V$ consisting of 14 bits in which bit B10 represents the carry signal CA and 3 bits of "000" are added to the upper orders of the bit B10, whereby the information $\log_2 Vo'$ is multiplied with 1.33 and the maximum value of the information $\log_2 V$ is limited to a value corresponding to 1200 cents.

Consequently, with the circuit shown in FIG. 13, the upper limit of the variation range of the generated musical tone is 1200 cents (one octave).

Especially, in this modification the calculation speed can be increased because the multiplying operation is performed with simple addition operations.

Accordingly, the electronic musical instrument shown in FIG. 9 added with the pitch bending control information generator 10 having functions described above has the following additional advantages over the electronic musical instrument shown in FIG. 1. More particularly, a pitch bender effect can be obtained in which the nominal pitch of the generated musical tone sequentially and stepwisely varies by rotating the rotary knob 1000 for pitch bending to a desired cent position during performance after selecting the variation step width to a desired cent value with the transfer switch 101. Where the rotary knob 1000 for the pitch bending is fixed to a desired cent position, the tone pitch of the generated musical tone will be shifted from the normal tone pitch thus obtaining a so-called transposer effect. Where the rotary knob 1000 is rotated to a desired cent position and then allowed to automatically return to the original position a so-called choking effect can be obtained. Furthermore, where the rotary knob 1000 is reciprocated between 100 cents and 200 cents positions a so-called trill effect can be obtained.

The tone pitch of a musical tone generated by the electronic musical instrument according to this modification varies only in the upward direction because the pitch bending control information $\log_2 V$ varies only in the positive direction. However, it will be clear that it is possible to construct the circuit so as to obtain a pitch bender effect caused by the pitch variation which varies upward and downward about the nominal pitch. In this case, the central scale position of the rotary operator 1000 is labelled with zero cents and the opposite sides of the center zero cent position are graduated with plus and minus cents, and the value of the frequency information $\log_2 F$ outputted from the frequency information generator 2 is decreased by a value of $\log_2 V$ obtainable when the rotary operator 1000 is set to the zero cent scale position.

Although in the foregoing embodiments the invention was applied to obtain the glissando effect, the portamento effect and the pitch bender effect it should be understood that the invention is also applicable to obtain such other effects as the vibrato effect and glide effect. In these cases, a vibrato signal or a glide signal of the well known type is applied to the input of the A/D converter shown in FIG. 10. Where the vibrato and glide signals are digital data they are applied to the output side of the A/D converter.

Although in the foregoing embodiments, the frequency information $\log_2 F$ generated by the frequency information generator 2 and the unit variation width information $\log_2 P$ generated by the unit variation width information generator 4 were set as digital data, these data may be set as analog voltage signals. In this case the information generators 2 and 4 are constructed with combinations of analog memory devices, potentiometer circuits and gate circuits and the circuits succeeding the calculating circuit 6 may be constituted with suitable analog circuits.

What is claimed is:

1. An electronic musical instrument comprising:

keyboard means having a plurality of keys;

a frequency information generator for generating a first frequency information corresponding to a tone pitch designated by a depressed one of said keys;

a pitch variation information generator for generating a pitch variation information representing a discrete pitch step width;

a performer controllable pitch variation designator for enabling arbitrary designation by a performer, from a plurality of designatable values, of the magnitude of said pitch step width represented by said pitch variation information to be generated by said pitch variation generator;

calculating means for generating a second frequency information in accordance with said first frequency information and said pitch variation information, said second frequency information varying stepwisely from a first value to a second value in steps each having the width represented by said pitch variation information;

a musical tone signal generator for generating a musical tone signal having a frequency corresponding to the value of said second frequency information; and a sound system for converting said musical tone signal into a musical tone.

2. An electronic musical instrument according to claim 1 wherein said pitch variation designator designates pitch variation information which is suitable for imparting a glissando effect, a plurality of portamento effects, a pitch bending effect, transposing effect, choking effect or trill effect upon said musical tone.

3. An electronic musical tone according to claim 1 wherein said second value corresponds to a tone pitch of a key now being depressed.

4. An electronic musical instrument according to claim 1 wherein said first value corresponds to a tone pitch of a previously depressed key.

5. An electronic musical instrument according to claim 1 wherein said first value corresponds to the tone pitch of a key now being depressed.

6. An electronic musical instrument according to claim 1 wherein said second value corresponds to a tone pitch of a previously depressed key.

7. An electronic musical instrument according to claim 1 wherein said pitch variation information generator includes means for storing plural values of pitch variation information, and wherein said pitch variation designator includes means for designating which of said stored values of pitch variation information is to be accessed from said storing means and utilized as the generated pitch variation information.

8. An electronic musical instrument according to claim 1 wherein said pitch variation information generator includes means for determining the timing at which successive pitch variation information is generated for utilization by said calculating means.

9. An electronic musical instrument according to claim 1 wherein said calculating means comprises:

a register for storing a modified frequency information corresponding to the current value of said second frequency information;

a comparator for comparing said first frequency information with said modified frequency information;

arithmetic combining means, receiving said pitch variation information, for arithmetically combining said pitch variation information with said stored modified frequency information when said comparator does not detect the coincidence of said first frequency information and said modified frequency information, the resultant new current value second frequency information being stored in said register in place of the information previously stored therein.

10. An electronic musical instrument according to claim 9 wherein said calculating means further comprises:

a selector inserted between said register and said arithmetic combining means, for selecting whether said first frequency information or said resultant new current value second frequency information is supplied to said register for storage therein in place of the information previously stored therein, said selector selecting said first frequency information when said comparator detects the coincidence of said first frequency information and said modified frequency information, said selected first frequency information thereafter being stored in said register until production of said musical tone is completed.

11. An electronic musical instrument according to claim 10 which further comprises:

a glissando effect switch connected to said seletor, said seletor selecting only said first frequency information when said glissando effect switch is in a certain state.

12. An electronic musical instrument according to claim 1 which further comprises:

a pitch bend designator including a variable resistor which designates an amount of pitch deviation, means, cooperating with said pitch bend designator, for providing said pitch bend deviation data in incremental steps as said variable resistor is varied by an amount corresponding to said pitch deviation, and means for combining said pitch bend deviation data and said second frequency information and for providing the resultant information to said musical tone generator for generating a musical tone signal having a frequency corresponding to said resultant information, said musical tone signal thereby exhibiting a pitch bend effect.

13. An electronic musical instrument according to claim 12 wherein said pitch bend designator comprises an analog to digital converter.

14. An electronic musical instrument according to claim 12, which further comprises:

a variation step width designator for manually designating a variation step width of said pitch bend deviation data.

15. An electronic musical instrument according to claim 12 wherein said variable resistor comprises a manually operable rotary knob which when released after being rotated to a desired position returns automatically to an original position.

16. In an electronic musical instrument including a tone generator for generating a musical tone having a pitch established by a certain modified frequency information supplied thereto, a system for producing glissando, portamento, and like effects, comprising:

note frequency information generator means for producing note frequency information corresponding to a selected musical note;

unit variation width information generator means for providing a performer selectable unit variation data establishing, from among a plurality of selectable unit cent values, a fixed incremental change in pitch to be imparted to the generated tone;

speed control signal generator means for providing pitch variation clock pulses at a selectable rate;

calculating circuit means, operative at each occurrence of a pitch variation clock pulse, for arithmetically combining said note frequency information and said unit variation data to obtain a modified frequency information which is supplied to said tone generator to establish the pitch of the tone generated thereby, said established pitch varying stepwise at a rate established by the selected rate of said pitch variation clock pulses and changing incrementally in pitch by unit values established by the selected unit variation data.

17. In an electronic musical instrument having a tone generator for generating a musical tone having a pitch established by a certain modified digital frequency information supplied thereto, a system for producing a pitch bend effect, comprising:

note frequency information generator means for producing digital note frequency information corresponding to a selected musical note, a variable control element movable by a musician, variation step width transfer circuit means, cooperating with said variable control element, for providing digital pitch variation data in incremental steps in accordance with the rate and extent of movement of said variable control element, and arithmetic combining means for digitally arithmetically combining said note frequency information from said generator means and said pitch variation data provided by said circuit means to obtain a modified frequency information which is supplied to said tone generator to establish the pitch of the tone generated thereby, said established pitch varying incrementally in accordance with the rate and extent of movement of said variable control element.

18. A system according to claim 17 further comprising:

selector means, cooperating with said circuit means, for selecting the magnitude of each incremental step of the pitch variation data provided by said circuit means.

* * * * *